US009565873B2

(12) United States Patent
Zheng

(10) Patent No.: US 9,565,873 B2
(45) Date of Patent: Feb. 14, 2017

(54) METHOD OF PRODUCING PULP FOR USE IN ELECTRONIC CIGARETTE AND TRADITIONAL HOOKAH

(71) Applicant: CHANGNING DEKANG BIOTECHNOLOGY CO., LTD., Shenzhen, Guangdong (CN)

(72) Inventor: Zhixuan Zheng, Guangdong (CN)

( * ) Notice: Subject to any disclaimer, the term of this patent is extended or adjusted under 35 U.S.C. 154(b) by 514 days.

(21) Appl. No.: 14/232,909

(22) PCT Filed: Oct. 17, 2013

(86) PCT No.: PCT/CN2013/085387

§ 371 (c)(1),
(2) Date: Jan. 15, 2014

(87) PCT Pub. No.: WO2014/101533

PCT Pub. Date: Jul. 3, 2014

(65) Prior Publication Data

US 2014/0251354 A1 Sep. 11, 2014

(30) Foreign Application Priority Data

Dec. 28, 2012 (CN) ..... 2012 1 0594021

(51) Int. Cl.

| | |
|---|---|
| ***A24B 15/24*** | (2006.01) |
| ***A24B 15/26*** | (2006.01) |
| ***A24F 1/30*** | (2006.01) |
| ***A24F 47/00*** | (2006.01) |
| ***A24B 15/16*** | (2006.01) |

(52) U.S. Cl.

CPC ..... *A24B 15/26* (2013.01); *A24B 15/16* (2013.01); *A24B 15/167* (2016.11); *A24B 15/24* (2013.01); *A24F 1/30* (2013.01); *A24F 47/008* (2013.01)

(58) Field of Classification Search

USPC ..... 131/297, 298, 300, 309, 310, 347, 352

See application file for complete search history.

(56) References Cited

U.S. PATENT DOCUMENTS

2013/0008457 A1* 1/2013 Zheng et al. ..... A24B 15/24 131/297

FOREIGN PATENT DOCUMENTS

CN 102349699 A * 2/2012

* cited by examiner

*Primary Examiner* — Dennis Cordray

(74) *Attorney, Agent, or Firm* — Prakash Nama; Global IP Services, PLLC

(57) ABSTRACT

The present application is related to an electronic cigarette liquid and a method of producing pulp for use in the electronic cigarette liquid, the method includes: using a stainless steel bathing can with a 500 Liter capacity that can endure heating and pressurizing; placing the pulp and original liquid used for bathing inside the can at a pre-determined ratio. After heating, pressurizing and bathing, the absorption of the pulp is fully attained. Then, opening a ball valve and releasing and collecting only the liquid from the bathing can and taking out the viscous pulp for packaging. The hookah pulp product is obtained with a solid extract of the hookah pulp product being 90% or above of the hookah pulp product.

5 Claims, No Drawings

METHOD OF PRODUCING PULP FOR USE IN ELECTRONIC CIGARETTE AND TRADITIONAL HOOKAH

FIELD OF THE TECHNOLOGY

The present application is related to a method of producing pulp for relevant use in electronic cigarette and traditional hookah, which belongs within the field of chemical production technology.

BACKGROUND

Hookah is a tobacco product which is applied with a specialized "water tobacco pipe" tool for smoker to be taken after water (or other liquids) filtering. It is widely used in the Middle East. Hookah is different from other tobacco products in that it causes smoke to rise through the heat generated from coal burning. During smoking, the smoker needs to set coal fire on the tobacco surface to enable the tobacco to burn. The bottom of the container is filled with water, the top is filled with tobacco. The smoke released from the burning of the tobacco is smoked by the smoker after water filtering and via a straw.

Traditional raw materials of hookah are generally made from tobacco and various kinds of flavors. Such method has been applied for several centuries. Until now, the harm produced by hookah due to tobacco burning has been controversial.

Electronic cigarette liquid (or known as electronic cigarette atomizing solution) is a widely used real cigarette replacement. More and more smokers accept the use of electronic cigarette in lieu of real cigarette. Therefore, while the hookah pulp processed from the electronic cigarette liquid can satisfy the economic expectation comparable with traditional taking of hookah preserving the same quality of taste, it can reduce the harm caused to the body compared with the traditional tobacco. Hookah pulp can be applied in the currently popular electronic cigarette apparatus. Smoke can be realized from electronic heating to produce atomization, or can be realized from using the traditional method of baking the hookah through high temperature borne from the coal fire. Such product in itself maintains the original characteristics of the fruit in terms of shape, color and smell etc., and is a new product belonging to inventive craft.

SUMMARY

The purpose of the present application is to improve the traditional hookah raw material, and applies the same onto current electronic cigarette apparatus.

According to one aspect of the patent application, an electronic cigarette liquid, wherein is prepared from the following steps: weighting out tobacco leaf comprising 5-20% w/v of the electronic cigarette liquid and placing the same into an interlayered extracting can; adding a prepared solvent into the extracting can and bathing with tobacco leaf for 30-100 minutes; then adding heat to raise temperature to 40-60° C. and bathing the solvent for 2-8 hours, filtering the same and extracting remaining liquid, adding coco bean extract comprising 1-10% w/v of the electronic cigarette liquid to the remaining liquid for stirring and mixing for 20-40 minutes, then filling propylene glycol or glycerin into a 100% prepared electronic cigarette liquid for stirring and mixing for obtaining a final product.

Optionally, the prepared solvent is prepared by taking of propylene glycol or glycerin of 30-80% volume of the electronic cigarette liquid and polysorbate 80 of 0.1-0.5% of the electronic cigarette liquid, respectively, then stirring and mixing the two for 20-40 minutes for obtaining the evenly mixed solvent.

Optionally, the coco bean extract is prepared by crushing the coco beans to 20-60 meshes, then placing the same into the interlayered extracting can, then adding distilled water in a volume of 3-10 times the volume of the coco bean powder, bathing the coco bean powder for 30-90 minutes, then heating the temperature to 80-90° C. and remaining in conserved heat for 2-6 hours, then releasing the solution and filtering the same for obtaining the remaining liquid, then depressurizing and concentrating the remaining liquid to become an extract of 1.1-1.4 by weight ratio, then the coco bean extract is obtained.

Optionally, the propylene glycol or glycerin, and polysorbate 80 are all pharmaceutical or edible chemicals, the propylene glycol and glycerin can be used individually or in combination.

Optionally, adding the pulp into the electronic cigarette liquid, then the electronic cigarette liquid is absorbed with pulp through heating, pressurizing and bathing, after the pulp is absorbed with original liquid it becomes a viscous pulp or a liquid carrying solid pulp.

According to another aspect of the patent application, a method of preparing a pulp for traditional hookah includes the following steps:

(1) weighing out a certain amount of fresh pulp (the content of water should satisfy a requirement of craft);
(2) weighing out an electronic cigarette liquid of 5-20% (w/v) of a hookah pulp, adding the same into a bathing can, heating the same to 40-60° C., pressurizing the same to 1 Mpa, bathing the same for 2-8 hours; and
(3) opening a ball valve, releasing the liquid from the bathing can, collecting and taking out viscous pulp for packaging, and the hookah pulp product is obtained with a solid extract of the hookah pulp product being 90% or above of the hookah pulp product.

The advantages of the present application include: adding pulp made from plant extract to the electronic cigarette liquid, and the cigarette liquid is absorbed by the pulp through heating, pressurizing and bathing. The final product is formed after filtering. The present application is an inventiveness taken from the traditional hookah opium paste and is applied to the current electronic cigarette apparatus. The novelty of such preparation method is firstly the use of natural pulp which provides a psychologically satisfying sensation to the consumers. Secondly, a specialized craft is applied to prepare the electronic cigarette liquid, and the pulp is completely absorbed with the cigarette liquid through heating, pressurizing and bathing. Such product applies hookah or electronic cigarette apparatus for smoke. The natural fruit scent is fulfilling and the tobacco is hence aromatic. The visual and fragrance obviously excel those of traditional hookah opium paste and can better satisfy the high quality taste of the consumers.

DETAILED DESCRIPTION

Embodiment 1

Plan to prepare a 500 Liter of electronic cigarette liquid. Weight and take 50 kilogram of tobacco leaf and place the same within an interlayered extracting can; weight out 350 Liter of propylene glycol and 1 Liter of polysorbate 80, respectively. The polysorbate 80 is poured into the propylene glycol for stirring and mixing for 30 minutes. The mixture is added to the extracting can and bathed with tobacco leaf for 50 minutes. Then, vapor is infused into the interlayer and heat to a temperature of 50° C. After bathing under conserved heat for 4 hours, the liquid is released and filtered for obtaining the remaining liquid. The remaining liquid is added with 18 kilogram of coco bean extract for stirring and mixing for 30 minutes. Then, propylene glycol is added to the remaining liquid and poured into the prepared 500 Liter, for further stirring and mixing for 35 minutes. Then, the electronic cigarette liquid is formed. After obtaining the cigarette liquid, the cigarette liquid and pulp are placed inside the stainless steel bathing can. Upon bathing for 2-8 hours adding heat to filter the tobacco liquid, a hookah pulp product is produced.

Embodiment 2

Plan to prepare a 500 Liter of electronic cigarette liquid. Weight and take 50 kilogram of tobacco leaf and place the same within an interlayered extracting can; weight a 380 Liter of propylene glycol and glycerin in mixture at a ratio of 1:1, then weight out a 1.5 Liter of polysorbate 80. Pour the polysorbate 80 into the propylene glycol and glycerin mixture solution and stir and mix the same for 40 minutes. Then, add the mixture into the extracting can containing tobacco leaf and bath the same for 60 minutes. Then, vapor is infused into the interlayer and heat to a temperature of 60° C. After bathing under conserved heat for 6 hours, the liquid is released and filtered for obtaining the remaining liquid. The remaining liquid is added with 20 kilogram of coco bean extract for stirring and mixing for 40 minutes. Then, glycerin is added to the remaining liquid and poured into the prepared 500 Liter, for further stirring and mixing for 30 minutes. Then, the cigarette liquid is formed. The cigarette liquid and pulp are placed inside the stainless steel bathing can. Upon bathing for 2-8 hours adding heat to filter the tobacco liquid, a hookah pulp product is produced.

The invention claimed is:

1. A method of preparing pulp for use in electronic cigarette and traditional hookah, comprising the following steps: preparing an electronic cigarette liquid, adding the pulp into the electronic cigarette liquid, heating and pressurizing the electronic cigarette liquid added with the pulp and then allowing the pulp to bathe in the electronic cigarette liquid to absorb the electronic cigarette liquid, thereby making the pulp viscous or forming a liquid carrying the pulp in solid form;

said step of preparing the electronic cigarette liquid comprises the following steps: weighing tobacco leaf comprising 5-20% w/v of the electronic cigarette liquid to be prepared, placing the tobacco leaf into an extracting can, adding a solvent into the extracting can and allowing the tobacco leaf to bathe in the solvent for 30-100 minutes; then increasing a temperature in the extracting can to 40-60° C. and allowing the tobacco leaf to bathe in the solvent for 2-8 hours, filtering the solvent which has the tobacco leaf bathed in to obtain a solvent extract, adding coco bean extract comprising 1-10% w/v of the electronic cigarette liquid to the solvent extract to obtain a mixture, stirring and mixing the mixture for 20-40 minutes, then filling the mixture with propylene glycol or glycerin to reach a total volume of the electronic cigarette liquid intended to be prepared, stirring and mixing the mixture and the propylene glycol or the glycerin to obtain a final product.

2. The method for preparing pulp for use in electronic cigarette and traditional hookah according to claim 1, wherein preparation of the solvent comprises the following steps: taking propylene glycol or glycerin of 30-80% of the volume of the electronic cigarette liquid to be prepared and polysorbate 80 of 0.1-0.5% of the volume of the electronic cigarette liquid to be prepared, respectively, then stirring and mixing the two for 20-40 minutes to obtain the solvent which is evenly mixed.

3. The method of preparing pulp for use in electronic cigarette and traditional hookah according to claim 1, wherein the coco bean extract is prepared according to the following steps: crushing coco beans to 20-60 Tyler meshes to obtain coco bean powder, then placing the coco bean powder into a second extracting can, then adding distilled water into the second extracting can in a volume 3-10 times a volume of the coco bean powder, bathing the coco bean powder in the distilled water for 30-90 minutes, then heating a temperature in the second extracting can to 80-90° C. and maintaining the temperature for 2-6 hours to obtain coco bean solution, then pouring out the coco bean solution out of the second extracting can and filtering the coco bean solution to obtain a filtered coco bean solution, then depressurizing and concentrating the filtered coco bean solution to obtain the coco bean extract.

4. The method of preparing pulp for use in electronic cigarette and traditional hookah according to claim 2, wherein the propylene glycol, the glycerin, and the polysorbate 80 are all pharmaceutical or edible chemicals, the propylene glycol and the glycerin are used individually or in combination.

5. The method of preparing pulp for use in electronic cigarette and traditional hookah according to claim 1, also comprising the following steps:

before said step of adding the pulp into the electronic liquid, weighing an amount of the pulp at a weight of 5-20% of a weight of the electronic cigarette liquid;

in said step of adding the pulp into the electronic cigarette liquid, the pulp and the electronic cigarette liquid are contained in a bathing can;

in said step of heating and pressurizing the electronic cigarette liquid added with the pulp, the electronic cigarette liquid added with the pulp is heated to 40-60° C.; and pressurized to 1 Mpa; in said step of allowing the pulp to bathe in the electronic cigarette liquid to absorb the electronic cigarette liquid, the pulp is bathed in the electronic cigarette liquid for 2-8 hours; and after the pulp is bathed in the electronic cigarette liquid for 2-8 hours, thereby making the the pulp viscous or forming the liquid carrying the pulp in solid form, opening a ball valve of the bathing can, pouring out the viscous pulp or the liquid carrying the pulp in solid form from the bathing can for packaging.

* * * * *